US006170426B1

(12) United States Patent
Thorsbakken

(10) Patent No.: US 6,170,426 B1
(45) Date of Patent: Jan. 9, 2001

(54) APPARATUS AND METHOD FOR PRODUCING WET AND DRY PADS

(76) Inventor: Arden L. Thorsbakken, Rte. 6, 4204 Tamara Dr., Eau Claire, WI (US) 54701

( * ) Notice: Under 35 U.S.C. 154(b), the term of this patent shall be extended for 0 days.

(21) Appl. No.: 09/165,401

(22) Filed: Oct. 2, 1998

Related U.S. Application Data

(63) Continuation-in-part of application No. 08/943,942, filed on Oct. 3, 1997, now Pat. No. 6,085,899.

(51) Int. Cl.[7] ..... B65D 85/67

(52) U.S. Cl. ..... 118/43; 15/104.93; 428/486; 428/535

(58) Field of Search ..... 118/43, 104.9; 428/211, 206, 326, 486, 535; 15/104.93

(56) References Cited

U.S. PATENT DOCUMENTS

| | | | | |
|---|---|---|---|---|
| 2,440,974 | | 5/1948 | Resch . | |
| 2,613,879 | | 10/1952 | Carr . | |
| 2,759,830 | | 8/1956 | Touceda . | |
| 3,368,522 | | 2/1968 | Cordis . | |
| 3,868,052 | | 2/1975 | Rockefeller . | |
| 3,910,229 | * | 10/1975 | Spencer | 118/43 |
| 3,921,802 | * | 11/1975 | Thompson | 206/225 |
| 3,982,659 | | 9/1976 | Ross . | |
| 3,986,479 | | 10/1976 | Bonk . | |
| 4,069,789 | * | 1/1978 | Fukagawa | 118/43 |
| 4,262,816 | | 4/1981 | Margulies . | |
| 4,328,907 | | 5/1982 | Beard . | |
| 4,648,530 | | 3/1987 | Granger . | |
| 4,816,320 | * | 3/1989 | St. Cyr | 428/198 |
| 4,878,775 | * | 11/1989 | Nokbury | 401/132 |
| 4,936,452 | | 6/1990 | Pauley . | |
| 5,055,216 | * | 10/1991 | Johnson | 252/91 |
| 5,090,832 | * | 2/1992 | Rivera et al. | 401/132 |
| 5,509,593 | | 4/1996 | Bloch et al. . | |
| 5,660,313 | | 8/1997 | Newbold . | |
| 5,743,895 | | 4/1998 | Reiss et al. . | |
| 5,887,759 | * | 3/1999 | Ayigbe | 222/192 |
| 5,950,960 | * | 9/1999 | Marino | 242/594.5 |
| 5,971,138 | * | 10/1999 | Soughan | 206/210 |

* cited by examiner

*Primary Examiner*—Kevin Weldon
(74) *Attorney, Agent, or Firm*—Skinner and Associates

(57) ABSTRACT

Apparatus and methods for producing dry, wet or partially wet and partially dry segments of tissues. The tissue dispenser generally comprises a housing having a tissue egress passage, a tissue source of a predetermined quantity of dry tissue located in the housing, a fluid source of a predetermined volume of fluid located in the housing, and an actuatable application mechanism in fluid communication with the fluid source and operationally positioned proximate to the tissue egress passage. The application mechanism can be actuated to dispense fluid onto the tissue as the tissue passes through the tissue egress passage. A partially wet and partially dry tissue can be used to clean and dry an article. The tissue may generally comprise a cleansing pad having an impermeable membrane positioned between two tissue segments to form a wet tissue area and a dry tissue area. The impermeable membrane prevents fluid from bleeding into the dry tissue area. The tissue may also comprise a pad attached to a bubble of fluid. The bubble may be broken to release fluid onto the pad. The pad may consist of a bubble of fluid sandwiched between two layers of tissue. One surface of the bubble or bladder is weaker than the other, allowing fluid to be released onto only one layer of the tissue when the bubble is broken. The other side of the bubble may form a barrier to prevent the fluid from bleeding to the other tissue layer. The pad may be coated with a dry ingredient, which upon contact with the fluid from the broken bubble becomes an active solution.

5 Claims, 3 Drawing Sheets

APPARATUS AND METHOD FOR PRODUCING WET AND DRY PADS

CROSS-REFERENCE TO RELATED APPLICATIONS, IF ANY

This application is a continuation-in-part under 37 CFR 1.53(b)(1) of application Ser. No. 08/943,942, filed Oct. 3 1997, now U.S. Pat. No. 6,085,899.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to apparatus and methods for producing wet and dry pads or tissues. More particularly, the invention relates to apparatus and methods for releasing fluid onto a pad or tissue immediately prior to use and for maintaining a dry area on the tissue to create a wet and dry pad or tissue.

2. Background Information

The state of the art includes various devices and methods for dispensing tissues, such as those constructed from paper, cloth or gauze-type material. The tissue dispenser art includes packages of facial tissues, packages of moistened wipes such as baby wipes or facial wipes, and bandages. These tissues may contain or be impregnated with a type of fluid. Baby wipes may contain a mild soap-based cleaner, facial tissues may contain lotion, and bandages may contain an anti-bacterial agent. Furthermore, these tissues are packaged in different ways. For example, facial tissues and baby wipes are often boxed, and bandages and facial wipes are often individually packaged.

These devices and methods are believed to have significant limitations and shortcomings. Specifically, a tissue or cloth is typically either "wet" or "dry." However, a complete cleaning process requires the use of both a wet tissue to clean and/or disinfect a surface, and a dry tissue to dry the surface and remove debris. The cleaning process may entail carrying around a separate fluid supply for wetting and re-wetting the wet cloth, in addition to having to carry around both a wet and a dry cloth. Furthermore, the wet tissues have a tendency to dry out due to evaporation, which is a special concern with alcohol-based fluids like antiseptics because of the fast evaporation rate of alcohol. Even pre-moistened tissues stored in a sealed and relatively moisture resistant package tend to dry out over time. Therefore, wet tissues tend to have a relatively short shelf life. A further limitation of the known art is that it can be inconvenient, messy, and generally troublesome to wet or re-wet the tissue from a separate fluid supply, especially if concerned with the amount of fluid being absorbed by the tissue.

Block et al. (U.S. Pat. No. 5,509,593) show a combined wet and dry sanitary tissue dispenser that dispenses a roll of dry sanitary tissue from a first compartment and a roll of prewetted personal hygiene wipes from a second compartment. Margulies (U.S. Pat. No. 4,262,816) shows a package and dispensing device for a continuous roll of premoistened towelettes. Beard (U.S. Pat. No. 4,328,907) shows a dispenser form which individual, moistened paper tissues are pulled from a perforated source of tissue. Granger (U.S. Pat. No. 4,648,530) shows an automatic dispenser of pre-cut and z-wrapped or folded web materials. Bonk (U.S. Pat. No. 3,986,479) shows a premoistened towelette dispenser that utilizes a double lid and a pouch to prevent loss of moisture in the towelettes. Rockefeller (U.S. Pat. No. 3,868,052) shows a dispensing container for moist tissues. Ross (U.S. Pat. No. 3,982,659) shows a bulk package and dispensing device for substantially wet sheets.

Applicant'ss invention overcomes the limitations and shortcomings of the known art. An appropriate amount of fluid is applied to the tissue for cleaning purposes, and an appropriate amount of tissue may remain dry to both wipe a surface dry and to remove debris or grime from a surface. Premature drying of the tissue is prevented by applying the fluid to the tissue or pad immediately before use, rather than pre-moistening or impregnating the tissue.

BRIEF SUMMARY OF THE INVENTION

An embodiment of the present invention provides a wet and dry tissue dispenser which generally comprises: a housing having a tissue egress passage; a tissue source located in the housing, wherein dry tissue is disposed from the tissue source through the tissue egress passage; a fluid source located in the housing and having fluid communication to the tissue egress passage; and an actuation mechanism for applying fluid onto the tissue. In an alternative embodiment, the actuation mechanism includes a finger actuated compression mechanism, such as a flexible membrane button or a trigger, that allows an operator to expel a desired amount of fluid from the fluid source onto the tissue. The tissue may be manufactured with an impermeable membrane, such as an impervious poly barrier, to prevent unwanted bleeding of fluid from the wet area to the dry area. The impermeable membrane may be layered in between two absorbent tissues enabling one surface to be wet while the other surface remains dry, or may section both surfaces of the tissue to prevent the fluid from bleeding from a desired wet area of a surface into a desired dry area of the surface. Furthermore, the tissue or pad may contain a bubble or bladder of fluid. A user ruptures or fractures the bubble of fluid to release the fluid onto the pad to cause either the entire or only a portion of the pad to become wet.

Significant features of the invention include: the release or application of fluid onto the pad or tissue immediately before the pad is used to prevent contamination and evaporation; and the formation of distinct areas of the pad that are either wet or dry.

The present invention can be used in numerous places and situations. The invention can be used for personal hygiene purposes, and is especially useful to treat soft tissues such as hemorrhoid tissue. The irritated soft tissue area is gently sponged with a wet area of the pad. The pad is then turned over to expose a dry area which is used to gently pat dry the soft tissue. Thus, the invention eliminates the wet/sticky feeling associated with the use of a wet tissue alone, and it also eliminates the need to use another drying tissue from another source. The invention can be used to clean and disinfect, and is especially useful to clean medical and dental offices. The wet areas of the tissue moisten the surfaces. The tissue is turned over to expose a dry area that is used to dry the surfaces and remove debris. Furthermore, the present invention can clean windows and mirrors without excessive wetting and smearing. Additionally, the invention can be used to clean children and adults when water is not readily available, such as when a person is traveling, hunting or fishing for example. Importantly, the invention has a long storage life because the fluid is not applied or released onto the tissue until the tissue is ready to be used. Unlike other "wet" tissue products, the fluid in the present invention is stored in a separate container and will not evaporate. This benefit is especially important with volatile fluid such as alcohol-based fluids.

The features, benefits and objects of this invention will become clear to those skilled in the art by reference to the following description, claims and drawings.

DETAILED DESCRIPTION

Figure 1:
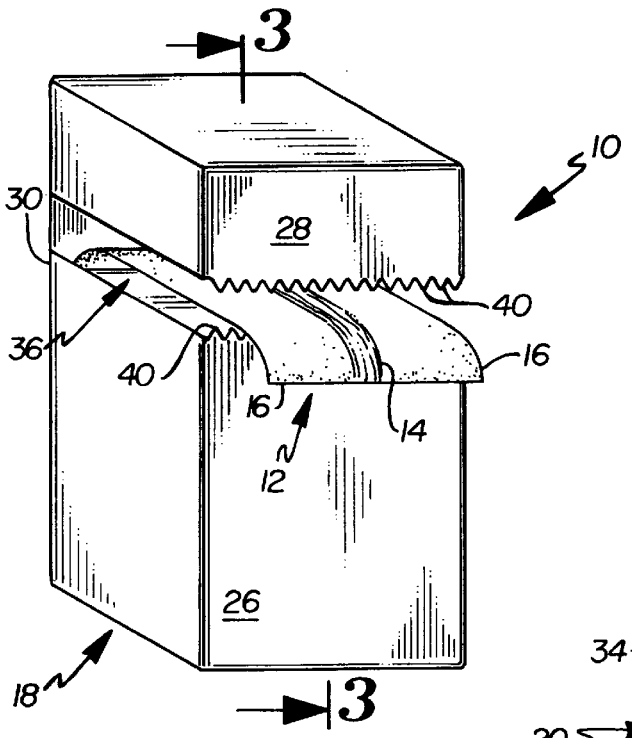
FIG. 1 is a perspective view of an embodiment of the wet and dry tissue dispenser.

Referring to FIGS. 1–5, an example of a tissue dispenser for dispensing wet and dry tissues is illustrated and generally indicated by the reference numeral 10. The tissue dispenser 10 is described below first in terms of its major structural elements and then in terms of its secondary structural and/or functional elements which cooperate to dispense wet, dry, or partially wet and partially dry tissues.

Figure 2:
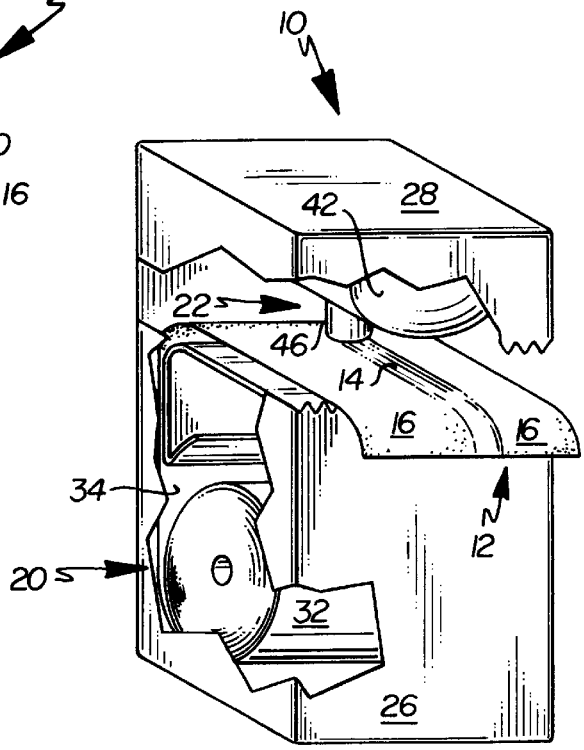
FIG. 2 is a perspective view, partially in cross-section, of the dispenser of FIG. 1.

Referring to FIGS. 1–2, the tissue dispenser 10 is shown dispensing a length of tissue or dispensed tissue segment 12. Fluid is applied onto the tissue as it is pulled or dispensed out of the dispenser 10. In the embodiment shown, the fluid is applied in such a manner as to dispense a tissue segment 12 having a generally centered wet portion 14 and two dry portions 16.

Figure 3:
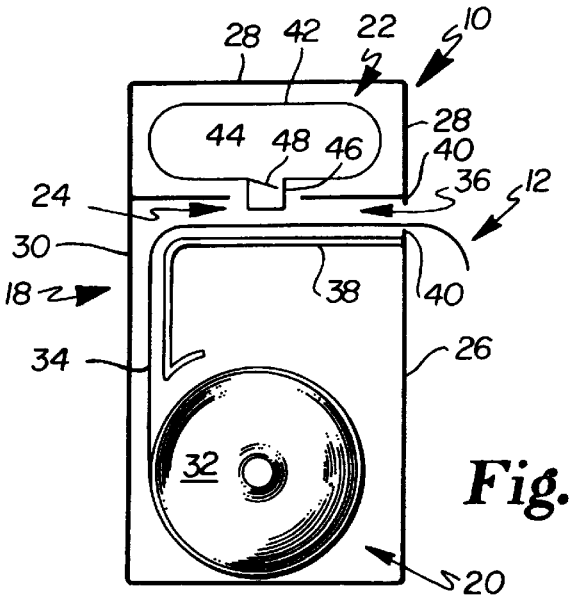
FIG. 3 is a cross-sectional view of the dispenser along line 3—3 of FIG. 1.
Figure 5:
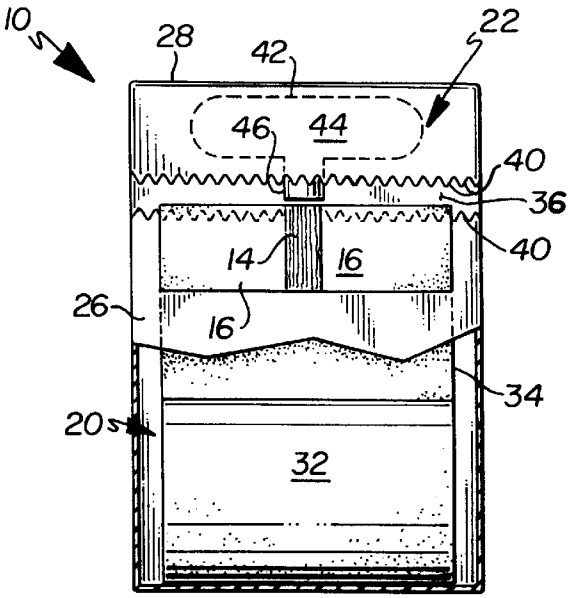
FIG. 5 is a front view of the dispenser.

FIG. 3 is a cross-sectional side view of the dispenser 10 along line 3—3 of FIG. 1. It shows the major elements of the dispenser 10 and how these elements interact to form a dispensed tissue segment 12 having a wet portion 14 and two dry portions 16. The dispenser 10 generally comprises a housing 18, a tissue source 20, a fluid source 22, and an application mechanism 24. The housing 18 of the preferred embodiment shown has a body portion 26 and a lid portion 28. The lid portion 28 is pivotally connected to the body portion 26 through a flexible hinge 30.

Figure 4:
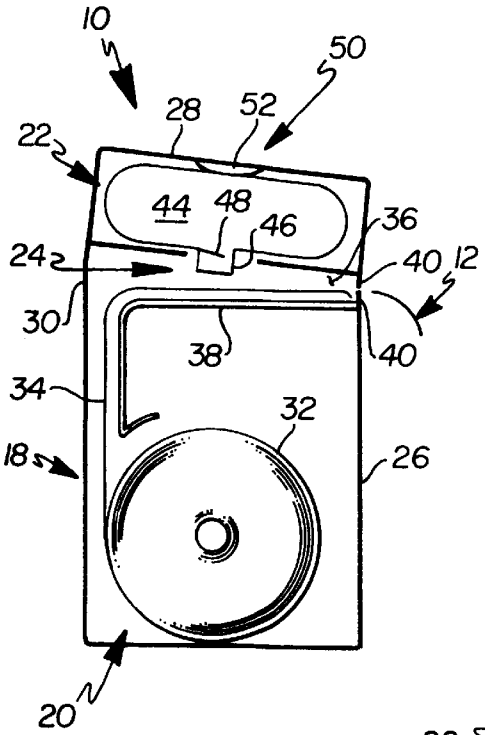
FIG. 4 is the cross-sectional view of FIG. 3 showing the dispenser cutting a tissue segment, and showing an embodiment of the finger actuated compression mechanism.

The tissue source 20 is a dry tissue roll 32, which is unwound into a draw segment 34 and is expelled from the dispenser 10 as a dispensed tissue segment 12. The draw segment 34 travels through a tissue egress passage 36 in the housing 18. A support element 38 forms part of the tissue egress passage 36. The support element 38 assists with maintaining the tissue roll 32 in place, guiding the draw segment 34 during the dispensing process, and supporting the draw segment 34 as fluid is applied by the application mechanism 24. As shown most clearly in FIG. 1, the housing 18 also contains a cutting bar 40 or serrated edge used to segment or cut the dispensed tissue segment 12. As shown in FIG. 4, the lid portion 28 of the housing 18 is manually pushed or pivoted down toward the body portion 26 to cut the dispensed tissue segment 12 to a desired length.

A preferred fluid source 22 is a bladder 42 having flexible walls. The bladder 42 contains a predetermined volume of fluid 44. The application mechanism 24 provides a controlled fluid communication means between the fluid source 22 and the tissue egress passage 36 where fluid 44 is applied to the draw segment 34. The application mechanism 24 includes at least one fluid exit orifice 46 or channel positioned near the tissue egress passage 36. The application mechanism may be actuatable in such a manner that it dispenses fluid onto the tissue if actuated by an operator and refrains from dispensing fluid onto the tissue if not actuated by the operator. Each orifice 46 contains a one-way valve 48 for dispensing fluid 44 onto the draw segment 34. The fluid 44 may be dispensed through gravitational force, capillary or sponge-like action, or through another compression or expansion force that expels the fluid 44 through a pressure sensitive oneway valve 48. For example, the application mechanism may apply a relatively constant amount of fluid onto the tissue when the tissue is pulled out of the dispenser 10 if the tissue rubs against the application mechanism 24. The application mechanism 24 also can dispense an adjustable amount of fluid 44 by using a finger actuated compression mechanism 50 to create a pressure differential between the inside and outside of the fluid source 22. FIG. 4 shows an embodiment of the dispenser 10 that includes a finger actuated compression mechanism 50 in the form of a flexible membrane button 52. It is anticipated that other finger-actuated compression mechanisms 50, such as a trigger device, could be used either to compress the bladder 42 to expel the fluid 44 or to extract the fluid 44 by suctioning it out of the fluid source 22.

In the embodiment shown in the figures, the tissue source 20 is located in the body portion 26 and the fluid source 22 is located in the lid portion 28. The tissue source 20 and fluid source 22 can be located in numerous different places within the housing 18, limited by the ability of the application mechanism 24 to apply fluid 44 onto the tissue. Since there are a number of suitable application mechanisms 24, there are also a number of possible arrangements of the tissue source, fluid source, and application member within any given housing design. Furthermore, where high volume use is anticipated, the tissue source 20 and fluid source 22 may be located in separate housings. For example, a public restroom or a hygienic environment such as a dentist or physician office may mount a tissue housing and a separate fluid housing on a wall. The tissue is still drawn past the application mechanism 24 where fluid is applied on to the tissue. This design permits bulk supplies of tissue rolls 32 and bulk supplies of fluid to be individually replaced as needed.

Figure 6:
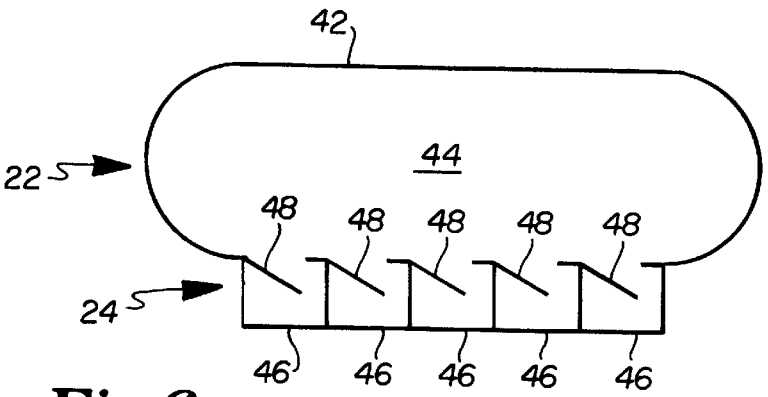
FIG. 6 is a plan view of an alternative fluid bladder containing multiple fluid orifices.

FIG. 6 shows an embodiment of a fluid source 22 or bladder 42 connected to multiple fluid exit orifices 46 and one-way valves 48. The arrangement of these orifices 46 determine the pattern of wet portions 14 and dry portions 16 on the dispensed tissue segment 12. Thus, the dispenser 10 could be designed to produce an all wet dispensed tissue segment 12 or a dispensed tissue segment 12 with a pattern of wet and dry areas. The dispenser 10 may also produce a dry dispensed tissue segment 12 simply by not applying fluid 44 onto the tissue.

Figure 7A:
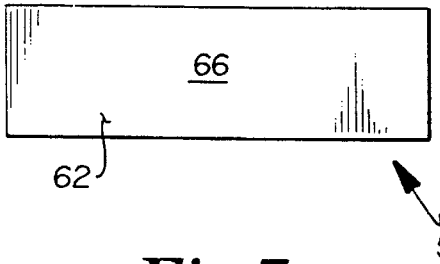
FIG. 7*a* is a top view of a tissue design incorporating a layer of poly barrier.
Figure 7B:
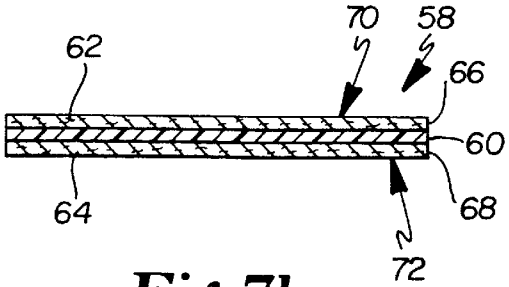
FIG. 7*b* is a side view of the tissue of shown in FIG. 7*a*.
Figure 7C:
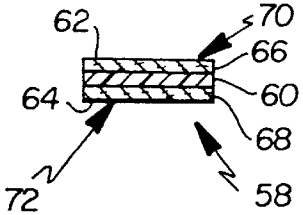
FIG. 7*c* is an end view of tissue shown in FIG. 7*a*.

FIGS. 7*a–c* and FIGS. 8*a–c* show tissue designs 58 that utilize an impermeable membrane 60, such as a polymer-based barrier or poly barrier, for preventing fluid from bleeding from a wet area 62 into a dry area 64 of the tissue. As shown in FIGS. 7*a–c*, an impermeable membrane 60 can be sandwiched between a first tissue layer 66 and a second tissue layer 68, and can effectively separate a wet first side 70 from a second dry side 72. Both sides 70 and 72 are initially dry. However, when the tissue is dispensed, fluid can be partially or thoroughly applied to the first side 70 to create a desired wet area 62 or moist area. The wet first side 70 can then be used to clean a surface and the dry second side 72 can be used to dry the surface. As illustrated in the second alternative tissue design shown in FIGS. 8*a–c*, impermeable membranes 60 can also be used to separate wet areas 62 from dry areas 64 on both the first side 70 and the second side 72 of the tissue. Fluid may be appropriately dispensed on the tissue using the tissue dispenser shown in FIG. 1 or another fluid dispensing means. These fluid dispensing means may consist of a pump or spray bottle.

Figure 9:
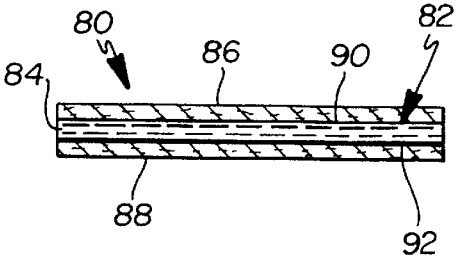
FIG. 9 is a cross-sectional view of a pad containing a fluid bubble.

The fluid dispensing means may also comprise a fluid bladder, pouch or bubble 82 formed within a pad 80. The bubble 82 may be fractured, punctured, ruptured or otherwise broken to dispense or release fluid 84 onto the pad 80. FIG. 9 illustrates a bubble fluid containment pad or "bubble pad" 80. Presently, cleansing pads are dispensed in water vapor containment packages or special dispensing containers that use an evaporation barrier to prevent evaporation of the fluid. An example of such a package is a box of baby wipes, the lid of which must be securely closed to prevent the drying out of the remaining pads. The bubble pad embodiment 80 of the present invention eliminates the need for a separate water vapor containment package because a sealed or intact fluid containing bubble 82 forms an evaporation barrier that prevents the fluid from escaping or evaporating. The bubble 82 is preferably constructed from a thin, flexible plastic material that is capable of being fractured, punctured, ruptured or otherwise broken to allow the fluid 84 from the bubble 82 to be released onto a desired side or a predetermined area of the pad 80.

The bubble 82 may be broken by squeezing the pad 80 between the hands. However, other means for breaking the bubble 82 are anticipated. For example, the bubble 82 could be punctured by rollers or confinement jaws as the pad is dispensed from a dispenser. A dispenser similar to the one illustrated in FIG. 1 may dispense either individual pads, each containing a fluid bubble, or a continuous roll of tissue with fluid bubbles spaced intermittently along the roll. The roll of tissue may be perforated in between the bubbles. The cutting bars 40 of the dispenser 10 may be adapted to break the fluid bubble as the pad is dispensed. In the case of the continuous roll, the dispenser 10 may be adapted to both cut the tissue into individual pads and to break the fluid bubble in each pad to release the fluid. The dispenser would not require a fluid source 22 since the fluid is contained within the bubble attached to the pad.

The poly barrier 60 used in the pads of FIGS. 7*a–c* and FIGS. 8*a–c* may be used in conjunction with the bubble pad 80 of FIG. 9 to cause only a portion of the pad 80 to become wet or moist. The bubble 82 would be contained within the desired wet area and bounded by the poly barrier 60. A side of the bubble 82 may form the poly barrier 60. The bubble 82 shown in FIG. 9 separates two layers of absorbent material to form a desired wet area 86 and dry area 88. The bubble 82 is manufactured with a thin side 90 that ruptures or breaks quicker than a thicker side 92. A wet area 86 is formed in the pad adjacent to the thin side 90 as soon as the bubble 82 is ruptured. The thicker side 92 forms a poly barrier that prevents the fluid 84 from bleeding from the wet area 86 into the dry area 88. The wet area 86 or side of the pad 80 may be used for cleansing and the dry area 88 or side of the pad 80 may be used for wiping and drying. Alternatively, rather than sandwiching the bubble 82 between two layers of material to form a wet side and dry side, the bubble 82 may be attached to only one tissue layer. When the bubble 82 is ruptured, all or a portion of the pad or tissue becomes wet.

Figure 10A:
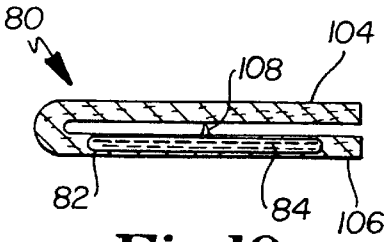
FIG. 10*a* is a cross-sectional view of a folded pad containing a fluid bubble.
Figure 10B:
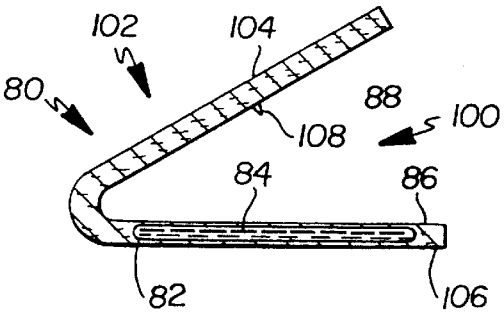
FIG. 10*b* is a cross-sectional view of the pad of FIG. 10*a* in an extended position.
Figure 8A:
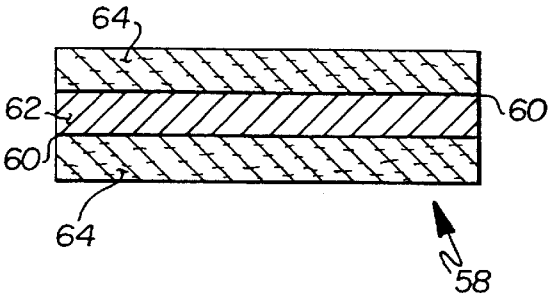
FIG. 8*a* is a top view of another tissue design incorporating poly barriers to divide the tissue into sections.
Figure 8B:
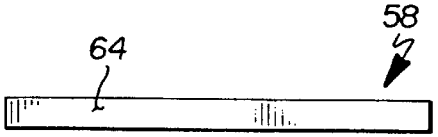
FIG. 8*b* is a side view of the tissue shown in FIG. 8*a*.
Figure 8C:
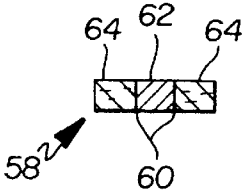
FIG. 8*c* is an end view of the tissue shown in FIG. 8*a*.

FIGS. 10*a* and 10*b* show another method for rupturing the bubble 82 within the pad 80. The pad 80 is manufactured in a folded manner to form an inside 100 and an outside 102, and to further form a first 104 and second 106 side. The figures show the bubble 82 attached to the second side 106. The portion of the bubble 82 in the first side 104 is attached to the second side 106. The bubble 82 is also attached to the first side 104 in such a manner as to cause the bubble 82 to rupture when the pad 80 is opened, after which the second side 106 of the pad 80 forms a wet area 86 while the first side 104 of the pad 80 remains a dry area 88. The figures also show a cloth or plastic filament 108 attaching the bubble 82 to the first side 104 of the pad 80. However, other means for rupturing the bubble 82 upon opening the pad 80 are anticipated, including the use of adhesives or ultrasonic welding. Poly barriers may be used to maintain distinct dry areas or sides on the pad 80. Both sides of the pad may contain a bubble and a poly barrier so that the inside 100 of the pad becomes wet and the outside 102 stays dry when the pad is opened.

The fluid may be water and/or an organic solute. The fluid may be an active ingredient itself, or it may only become active after the fluid reacts with another chemical upon contact with the dry ingredient or with the material or coating on the bubble or the pad. A dry antiseptic or other ingredient may be applied to the pad. This dry ingredient and the fluid may form a solution that is an active cleansing or disinfectant agent once fluid from the containment bubble is applied or released onto the pad. Other active ingredients may be applied to the opposite or dry side of the pad to provide further medicinal or cosmetic benefits. The solution formed by the fluid and the dry ingredient may allow a medicine to be applied topically. The solution may be an antiseptic or therapeutic solution, for example, that either penetrates the skin or functions on the surface of the skin. Examples of medicinal topical solutions that may be formed within the pad of the present invention include but are not limited to pain relievers and muscle relaxants.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A cleansing pad system, comprising:

(a) a dispenser including:
(i) a tissue source;
(ii) a fluid source; and
(iii) an application mechanism in fluid communication with said fluid source; and (b) a supply of tissue positioned in said tissue source, said supply of tissue including:
(i) at least one dry tissue area;
(ii) at least one wet tissue area forming at least one border with said at least one dry tissue area, said at least one wet tissue area being initially dry in said tissue source and being impregnated with fluid as said supply of tissue passes said application mechanism; and
(iii) an impermeable membrane positioned at each of said at least one borders between said at least one dry tissue area and said at least one wet tissue area, said impermeable membrane preventing bleeding of fluid from said at least one wet tissue area to said at least one dry tissue area.

2. A cleansing pad having a first side and a second side, comprising:

(a) at least one dry tissue area formed on both said first side and said second side;

(b) at least one wet tissue area formed on both said first side and said second side, said at least one wet tissue area forming at least one border with said at least one dry tissue area; and (c) an impermeable membrane positioned at said at least one border, said impermeable membrane preventing bleeding of fluid from said at least one wet tissue area to said at least one dry tissue area.

3. A cleansing pad, comprising:

(a) absorbent material containing a dry ingredient; and (b) a bubble attached to said material, said bubble containing a quantity of fluid, said bubble forming an evaporation barrier, said bubble being broken to release said fluid into said material, said fluid from said bubble combining with said dry ingredient to form an active solution.

4. A cleansing pad, comprising:

(a) absorbent material forming a desired wet area and a desired dry area, said absorbent material being folded to form a first side and a second side; and (b) a bubble attached to both said first side and said second side of said material, said bubble containing a quantity of fluid, said bubble forming an evaporation barrier and forming an impermeable membrane between said desired wet area and said desired dry areas, said bubble being broken to release said fluid into said desired wet area of said material, said bubble being broken when said first side is separated from said second side.

5. A cleansing pad system comprising:

(a) a dispenser including:
(i) a tissue source; and
(ii) a bubble breaking device; and (b) a supply of tissue positioned in said tissue source including:
(i) absorbent material; and
(ii) a bubble attached to said material, said bubble containing a quantity of fluid, said bubble forming an evaporation barrier, said bubble being broken to release said fluid into said material, said bubble being broken by said bubble breaking device of said dispenser as said supply of tissue is dispensed from said dispenser.

* * * * *